United States Patent [19]

Holter et al.

[11] 4,305,168

[45] Dec. 15, 1981

[54] HOSPITAL BED

[75] Inventors: Heinz Holter, Gladbeck; Heinz Gresch, Dortmund-Derne, both of Fed. Rep. of Germany

[73] Assignee: Industrie-Wert Beteiligungsgesellschaft mbH, Mainz, Fed. Rep. of Germany

[21] Appl. No.: 57,549

[22] Filed: Jul. 13, 1979

[30] Foreign Application Priority Data

| | | | |
|---|---|---|---|
| Jul. 22, 1978 | [DE] | Fed. Rep. of Germany | 2832262 |
| Jul. 22, 1978 | [DE] | Fed. Rep. of Germany | 2832332 |
| Aug. 19, 1978 | [DE] | Fed. Rep. of Germany | 2836378 |

[51] Int. Cl.[3] ..... A47C 21/04; A47C 21/00

[52] U.S. Cl. ..... 5/512; 5/284; 5/469; 5/482

[58] Field of Search ..... 5/468, 469, 512, 423, 5/421, 284, 159 V, 97, 304, 482, 414

[56] References Cited

U.S. PATENT DOCUMENTS

| | | | |
|---|---|---|---|
| 630,565 | 8/1899 | Safran | 5/469 |
| 1,142,876 | 6/1915 | Davis et al. | 5/469 |
| 2,097,751 | 11/1937 | Baltich | 5/284 |
| 2,235,966 | 3/1941 | Summers | 5/423 |
| 2,375,941 | 5/1945 | Nostrand | 5/512 |
| 2,601,189 | 6/1952 | Wales | 5/284 |
| 3,012,254 | 12/1961 | Hamilton | 5/414 |
| 3,101,488 | 8/1963 | Peebles | 5/469 |
| 3,266,064 | 8/1966 | Figman | 5/469 |
| 3,449,776 | 6/1969 | Brock | 5/114 |
| 3,486,177 | 12/1969 | Marsmack | 5/469 |
| 3,681,797 | 8/1972 | Messner | 5/469 |
| 3,928,876 | 12/1975 | Starr | 5/469 |
| 4,109,331 | 8/1978 | Champeau | 5/512 |

*Primary Examiner*—Roy D. Frazier
*Assistant Examiner*—Alexander Grosz
*Attorney, Agent, or Firm*—James C. Wray

[57] ABSTRACT

A hospital bed has ducts with openings in a frame and a mattress and blanket connected by a hose to an exhauster and filter. A hood formed of several panels at a head of a bed reduces noise and provides ventilation.

8 Claims, 7 Drawing Figures

FIG. 1
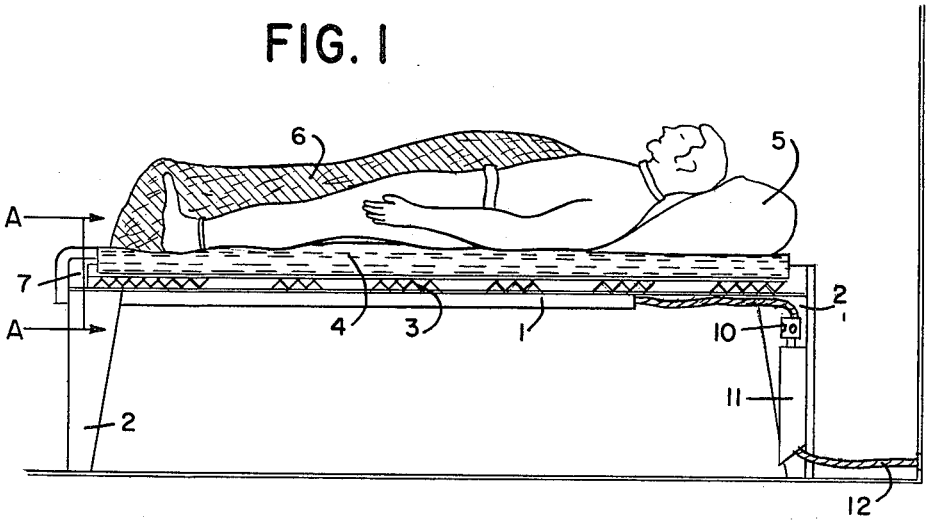
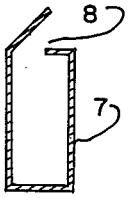
FIG. 2
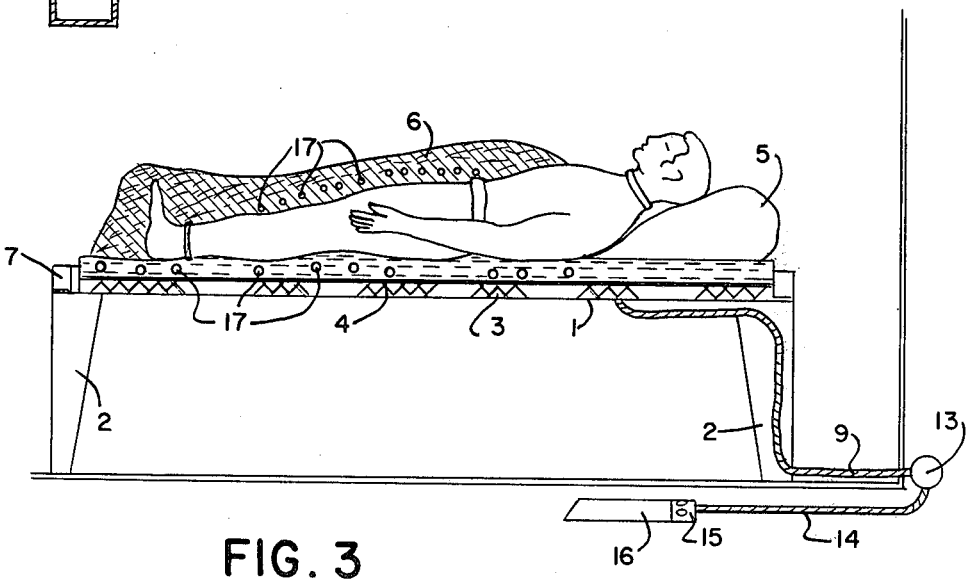
FIG. 3
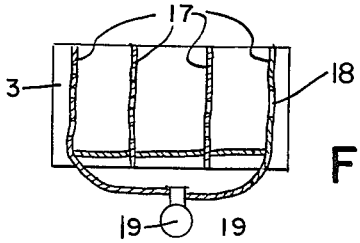
FIG. 4

HOSPITAL BED

BACKGROUND OF THE INVENTION

The invention concerns a hospital bed or similar item of furniture to lay or sit on with a frame and a surface-bearing area for a mattress.

Frequently, in a hospital room several beds are set up and are occupied at the same time by sick persons. If the persons are seriously sick, they cannot leave their bed. Then, the whole life cycles of the patients take place in their beds. Patients are often helpless and they can only inadequately control or master the physiological process of their bodies. Therefore, it is difficult to avoid annoying odors that will develop and which might bother the other patients sharing the same room. Annoying odors can also develop from wounds or cuts or during change of surgical dressings. Those procedures will most of the time also bother the other patients sharing the room, because patients are usually sensitive to odors. Such odors are also annoying to visitors.

SUMMARY OF THE INVENTION

The invention has the target to remove annoying odors from the patients' rooms.

The solution is a special hospital bed characterized in such a way that the frame of the bed consists of a hollow section with openings to draw off the odors. This system can be connected to a source of reduced pressure with a special added filter.

According to the invention, the air in the area of the hospital bed will be drawn off and filtered. After that procedure, the air can be recirculated, if desired (for example, during the cold season), or the air can be released into the atmosphere (for example, during the warm season). By withdrawing the air, the odors which are developed in the vicinity of the sick person or the hospital bed are also removed so that they cannot anymore annoy the other patients sharing the same room or any visitors.

In very serious cases, suction channels with openings can be installed between multisectional mattresses and/or the blankets may include those suction channels with suction openings. Those suction channels can also be connected to the reduced pressure source.

For practical reasons an exhauster should be used as the reduced pressure source. The filter should be an adsorption and/or disinfection filter.

The filter and the exhauster can be hooked directly to the frame of the hospital bed. From there the withdrawn and filtered air can be released into the hospital room or into the atmosphere, as desired. However, it is also possible to install a central filter and suction system in the hospital. Each individual bed can then be connected to this central system by means of a connecting duct provided with a valving system. Depending on the hospital's requirements, several hospital beds in one room can be connected to such a central system.

Another problem is the noise annoyance especially caused by snoring during night time if several patients share the same hospital room. To reduce or restrain those snoring noises, it is recommended to install at the head of the bed a noise barrier which can be lowered or is collapsible. The noise barrier can consist of several platelike, sound proof parts, each of which are directly installed on the bed frame. Those panels should be collapsible or lowerable, forming a hood at the head of the bed. For example, this hood can be erected in the evening and removed in the morning. If desired, the side panels of this hood can be equipped with speakers. The side panels or other parts of this hood may have air slots to allow better ventilation. If desired, the patient can listen to the radio without bothering other patients in the same room.

BRIEF DESCRIPTION OF THE DRAWINGS

FIG. 1 is a schematic side view of a hospital bed.

FIG. 2 is a schematic cross-section of the frame of a hospital bed taken along line A—A of FIG. 1.

FIG. 3 is another schematic example of a side view of a hospital bed according to FIG. 1.

FIG. 4 is a plan view of a hospital bed according to FIG. 3, with additional arranged suction channels.

DETAILED DESCRIPTION OF THE DRAWINGS

Figure 7:
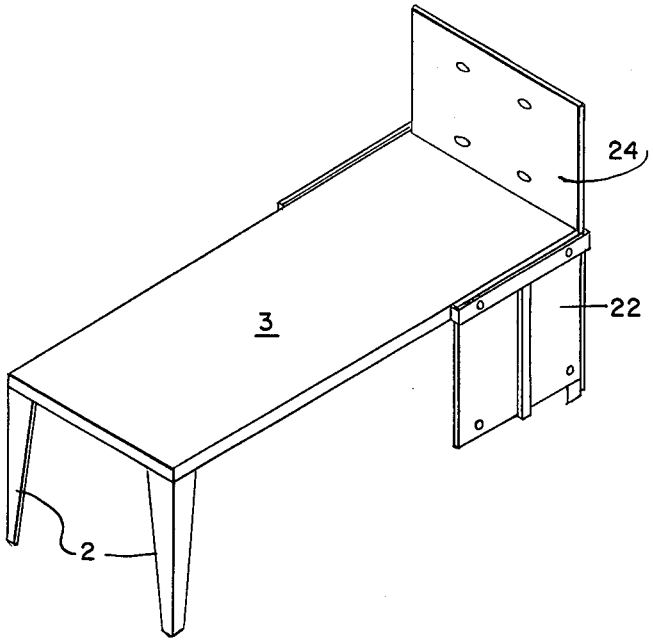
FIG. 7 is a hospital bed, according to FIG. 6, with removed noise barrier.

The hospital bed shown on the attached drawings principally consists of a frame 1 with supports 2, and a bearing-surface area 3 for a mattress 4. Furthermore, a pillow 5 and a blanket 6 will belong to a complete bed.

As can be seen on FIGS. 1–4, the frame 1 usually consists of a hollow section 7 of a more or less rectangular cross-section, where on the upper side of this hollow section suction openings 8 are arranged at specified spacings. For this purpose, according to FIG. 2, parts of the upper side of the hollow section 7 are cut open and bent up. The hollow frame 1 is connected by means of a hose 9 to an exhauster 10 and an added filter 11. From the filter 11 a hose 12 leads into the open atmosphere. If the exhauster is turned on, the air in the vicinity of the hospital bed is drawn in together with the odors, which are developed from the sick person or in the area of the hospital bed. The odors will be filtered in the filter 11, which is an absorption and/or disinfection filter, and disinfected. The so cleaned air will be released into the atmosphere by means of a hose 12.

Figure 5:
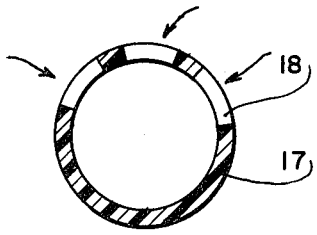
FIG. 5 is a schematic cross-section of a suction channel.

The same numbering system is used for the examples shown on FIGS. 3–5 to better identify identical parts.

The suction hose 9 leads into a socket 13 in the wall of the hospital. A connecting duct 14 is hooked to the central system in the hospital consisting of an exhauster 15 with an added filter 16. Several of those ducts are connected to the exhauster and the filter system, so that several beds in different rooms of the hospital can be connected to this central system. The socket 13 is equipped with a valving device that will shut off the connecting duct 14 when the suction hose 9 is pulled out of the socket 13.

As shown especially in FIGS. 3 and 5, suction channels 17 with suction openings 18 are embedded in the mattress 4 and the blanket 6. Those suction channels can also be connected to the frame 1 or the suction hose 9, so that air can also be drawn in immediately from the mattress and the blanket. This is demonstrated by the arrows in FIG. 5.

Figure 6:
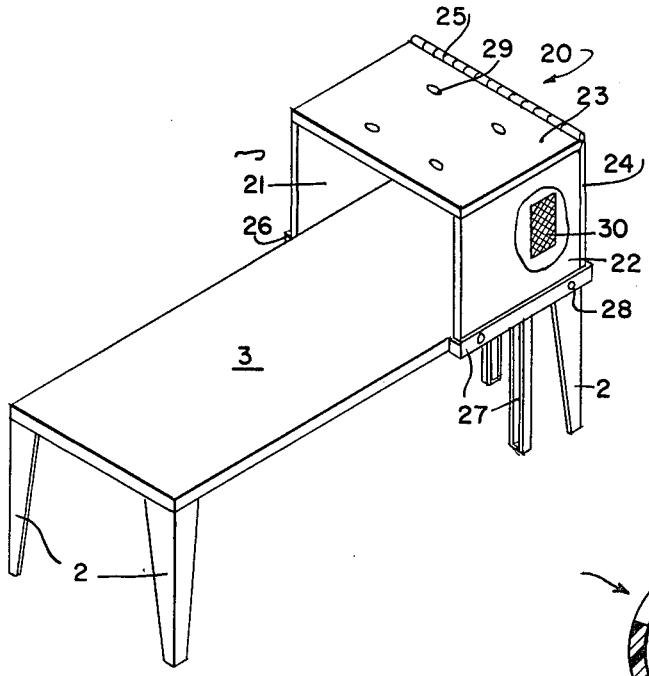
FIG. 6 is a hospital bed with a noise barrier installed at the head of the bed.

As shown in FIG. 4, additional suction channels 17 with suction openings 18 can be arranged between multisectional mattresses immediately on the bearing-surface area 3. Those suction channels can also be connected to the hollow frame or the suction hose 9 by using special couplings or adapters 19, as required. The FIGS. 6 and 7 show a hospital bed with a hood-like noise barrier 20 which especially should reduce and insulate snoring noises. The hood-like noise barrier consists of several plate-like panels, which are covered with sound-proof materials. Those parts are side panels 21 and 22, top panel 23 and back panel 24. As can be seen on FIGS. 6 and 7, the top panel 23 is connected to the back panel 24 with hinges 25 to form a swivel bearing. Guide frames 26 and 27 attached to the surface bearing area 3 will allow one to safely lower the side panels 21 and 22, which can be fixed with pins 28 at an upper position as shown in FIG. 6. To increase the air circulation when the hood-like noise barrier 20 is erected, top panel 23 and back panel 24 have air ventilation slots 29. The side panels 21 may have built-in speakers 30.

During the daytime when the noise barrier is removed, the different panels will be in a position as shown in FIG. 7. To erect the hood-like noise barrier 20, the side panels 21 and 22 will be pulled up through the guide frames 26 and 27 into their upper position and fixed with the pins 28. Then the top panel 23 will be rotated around the hinges 25 until it will bear on the upper edges of the side panels 21 and 22. The so formed hood will effectively reduce and insulate snoring noises so that other persons in the hospital room, especially patients, will not be bothered by those noises.

We claim:

1. The hospital bed apparatus comprising vertical leg supports, a frame positioned on the leg supports, a sound proof head board at one longitudinal end of the frame, the head board having an upper edge, a hinge connected to the upper edge of the head board, guide frames connected to opposite sides of the head board, guide frames connected to opposite sides of the frame near the head board, a top sound proof panel connected to the hinge on the upper edge of the head board for swinging to a position parallel to the frame, sound proof side panels connected to the guide frames for moving upward to a position whereby an upper edge of each side panel connects with a lateral area of the top panel, and ventilation openings in the panels.

2. A hospital bed apparatus comprising leg supports, a generally horizontal frame positioned on the leg supports and forming a surface-bearing area for a mattress, the frame having at least one hollow section, a mattress disposed upon the surface-bearing area, a hose and means for connecting a hose to the hollow sections of the frame, exhaust means connected to the hose and filter means connected to the hose for exhausting and filtering air from the said hollow section of the frame through the hose, exhausting means and filtering means, whereby air is withdrawn from spaces immediately adjacent to the mattress for controlling and reducing spread of odors and disease from the spaces, said hospital bed apparatus further comprising a noise barrier headboard connected to the frame, a sound proof panel hingedly connected to the headboard for lowering to a position substantially parallel with the mattress bearing area, guide frames attached at opposite sides to the frame, and sound proof side panels connected to the guide frames for moving upward to join the top panel in completion of a soundproof enclosure at a head end of the bed, and air ventilation slots in the panels.

3. Hospital bed apparatus according to claim 2, thus characterized that between mattress sections, suction channels with suction openings are arranged and the mattress sections and a cover contain suction channels with suction openings which can also be connected to the hose.

4. Hospital bed apparatus according to claim 2 or 3, thus characterized that the filter means is an adsorption and disinfection filter.

5. Hospital bed according to one of claims 2 or 3, thus characterized that a central filter with an exhauster and special connecting ducts with valves is installed in a hospital so that several beds can be connected to this central system.

6. The hospital bed apparatus of claim 2 wherein the mattress has suction channels imbedded therein with suction openings in the suction channels and wherein the hose is connected to the suction channels within the mattress.

7. The hospital bed apparatus as claimed in claim 6 further comprising a blanket positioned on top of the mattress, the blanket having suction channels imbedded in the blanket and suction openings in the suction channels, and wherein the suction channels are connected to the suction hose.

8. The hospital bed apparatus of claim 6 further comprising additional suction channels disposed on the surface-bearing area and suction openings in the additional suction channels, wherein the additional suction channels are connected to the hose.

* * * * *